US005729422A

United States Patent [19]

Henke

[11] Patent Number: 5,729,422

[45] Date of Patent: Mar. 17, 1998

[54] DEVICE AND METHOD FOR TRIGGERING AN ELECTROMAGNETIC CONSUMER

[75] Inventor: Torsten Henke, Waiblingen, Germany

[73] Assignee: Robert Bosch GmbH, Germany

[21] Appl. No.: 553,709

[22] PCT Filed: Mar. 24, 1995

[86] PCT No.: PCT/DE95/00408

§ 371 Date: Dec. 4, 1995

§ 102(e) Date: Dec. 4, 1995

[87] PCT Pub. No.: WO95/28721

PCT Pub. Date: Oct. 26, 1995

[30] Foreign Application Priority Data

Apr. 16, 1994 [DE] Germany ..... 44 13 240.9

[51] Int. Cl.[6] ..... H01H 47/36

[52] U.S. Cl. ..... 361/156

[58] Field of Search ..... 361/154–156, 361/159; 123/490

[56] References Cited

U.S. PATENT DOCUMENTS

| | | | |
|---|---|---|---|
| Re. 30,150 | 11/1979 | Puvogel | 361/156 |
| 3,467,894 | 9/1969 | Blume | 361/159 |
| 3,896,346 | 7/1975 | Ule . | |
| 4,631,736 | 12/1986 | Yamanoue et al. | 307/44 |
| 5,036,422 | 7/1991 | Uchida et al. | 361/159 |
| 5,040,514 | 8/1991 | Kubach | 361/159 |

FOREIGN PATENT DOCUMENTS

| | | |
|---|---|---|
| 0 088 445 | 9/1983 | European Pat. Off. . |
| 0 548 915 | 6/1993 | European Pat. Off. . |
| 1115785 | 10/1961 | Germany . |
| 37 02 680 | 10/1987 | Germany . |
| 37 34 415 | 4/1989 | Germany . |
| 0729743 | 4/1980 | U.S.S.R. . |
| 1 106 746 | 3/1968 | United Kingdom . |
| 2 144 280 | 2/1985 | United Kingdom . |

*Primary Examiner*—Fritz Fleming
*Attorney, Agent, or Firm*—Kenyon & Kenyon

[57] ABSTRACT

A device and a method are described for triggering an electromagnetic consumer, in particular a solenoid valve for controlling the fuel quantity to be injected. An energy-storing element is arranged between a half-bridge and a voltage source.

12 Claims, 5 Drawing Sheets

DEVICE AND METHOD FOR TRIGGERING AN ELECTROMAGNETIC CONSUMER

BACKGROUND INFORMATION

Devices and methods for triggering an electromagnetic consumer, in particular a solenoid valve for controlling the fuel quantity to be injected, by means of a half-bridge are known. In these devices, the energy released during the switch-off operation is converted by means of Zener diodes into heat and is lost.

A device for triggering an electromagnetic consumer is described in German Patent Application No. 37 02 680. It describes a circuit arrangement for triggering an electromagnetic consumer. An electronic switching element connected in series to the consumer is able to be bridged by a quenching circuit. This quenching circuit contains an energy store in the form of a capacitor for taking up energy stored in the consumer. The disadvantages associated with this circuit arrangement are that it is complicated and expensive with respect to component parts and, to temporarily store energy, requires a voluminous capacitor which is continually charged at least to supply voltage. In addition to the capacitor, at least two series diodes are needed.

In this device, for every switching operation, the energy stored in the consumer is stored in a capacitor. This temporarily stored energy is conducted into a second consumer during the next triggering operation.

In addition, a device for triggering a consumer is described in German Patent Application No. 37 34 415. It discusses storing the energy released during the switch-off operation in a capacitor. During the switch-on operation, the stored energy is supplied to the consumer. To this end, at least two more switching means are required than is the case in a device without energy feedback.

SUMMARY OF THE INVENTION

The underlying object of the present invention, given a device for triggering an electromagnetic consumer, is to make available a device having a simplest possible construction, which will enable the switch-on operation to be accelerated and the total energy consumption to be minimized.

The circuit arrangement according to the present invention has the advantage of achieving a loss-less quenching operation. In addition, when the energy stored during the quenching operation is used again during the switch-on operation, the rise in current can be intensified. This leads, in turn, to a reduction in the solenoid valve switching time. These advantages are achieved with a minimal expenditure for component parts.

DETAILED DESCRIPTION

The device according to the present invention is preferably used in internal combustion engines, especially in self-ignition internal combustion engines. In engines of this type, the fuel metering is controlled by electromagnetic valves. These electromagnetic valve are referred to in the following as consumers. However, the present invention is not limited to this application; it can be applied wherever high-speed switching electromagnetic valves are needed.

In such applications, the opening and closing instants of a solenoid valve establish the beginning and end of injection, respectively.

Usually, the time period between the triggering of the solenoid valve and the actual opening or closing of the solenoid valve is described as the switching time. In diesel gasoline engines, in particular, it is desirable for the switching time to be as short as possible.

To attain the shortest possible switching times, it is necessary to have a fast possible build-up or reduction of force in the consumer. Such a fast build-up or reduction of force can be achieved by a correspondingly fast build-up or reduction of current.

Figure 1:
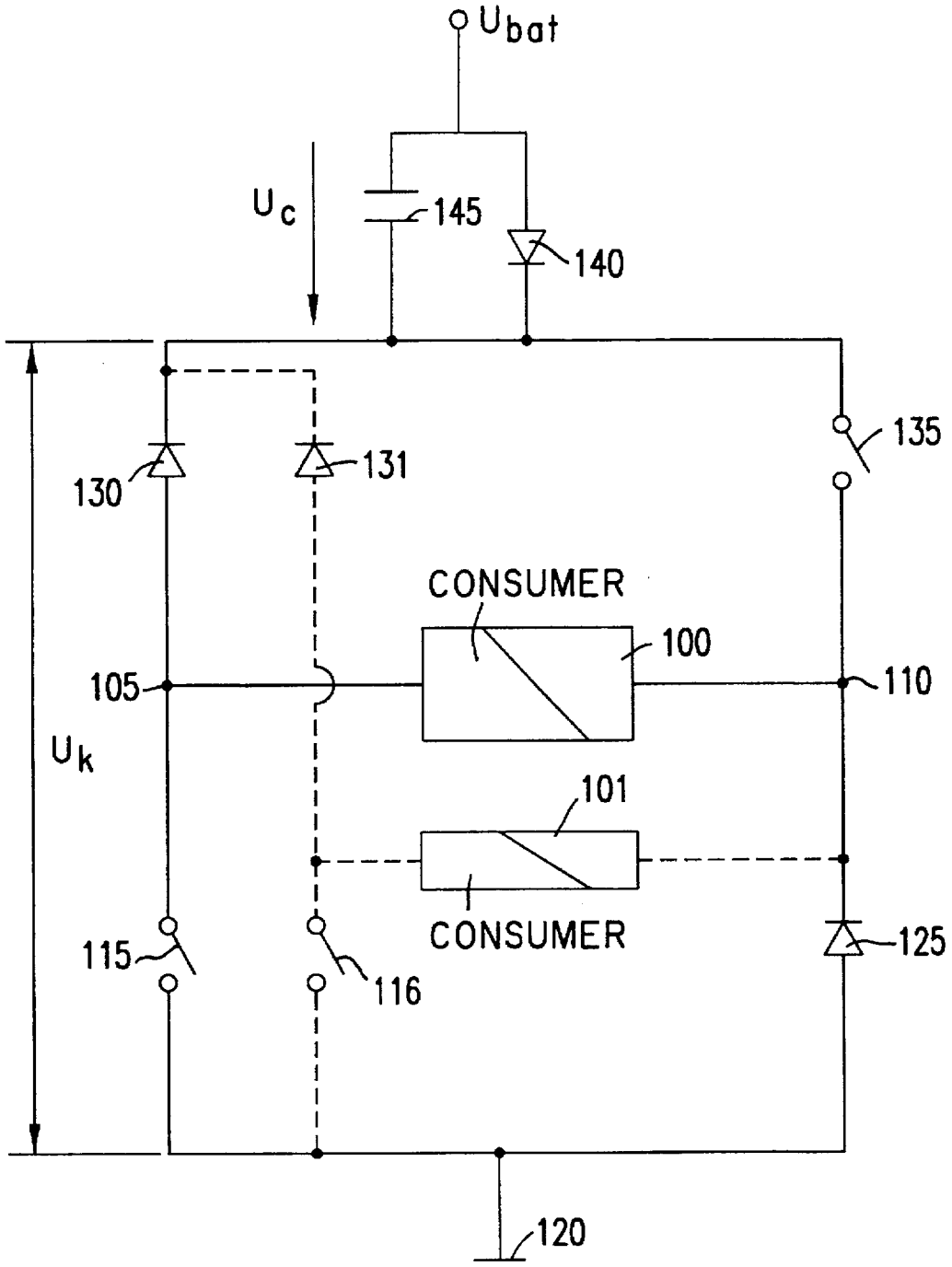
FIG. 1 shows a first circuit arrangement of the device according to the present invention.

The most important elements of the device according to the present invention are depicted in FIG. 1. 100 denotes the consumer to be triggered. A first terminal connection of the consumer 100 is connected to a node 105, and the second terminal connection to a node 110. The node 100 is connected via a first switching means 115 to the grounded connection 120. The second node 110 is in contact with the cathode of a first diode 125. The anode of the first diode 125 is connected to a frame potential.

Furthermore, the node 105 is in contact with the anode of a second diode 130. The node 110 is in contact via a second switching means 135 with the cathode of the second diode 130.

The connection junction point between the cathode of the second diode 130 and the switching means 135 is in contact, first of all, with the cathode of a third diode 140 and the one terminal connection of a capacitor 145. The second connection terminal of the capacitor 145 and the anode of the third diode 140 are connected to a voltage source which provides them with a supply voltage $U_{bar}$.

The configuration including the consumer 100, the two switching means 115 and 135, and the first and second diodes 125 and 130 is usually described as a half-bridge.

Customarily, several solenoid valves are needed to meter fuel in internal combustion engines. A specific embodiment comprising two solenoid valves is shown with dotted lines. In this case, the cathode of another diode 131 is connected to the cathode of the diode 130. The anode of the other diode 131 is in contact with a switching means 116 and with the one terminal connection of the other consumer 101. By way of the switching means 116, the anode of the diode 131 and the one terminal connection of the consumer 101 are connected to ground. The second terminal connection of the consumer 101 is contacted by the cathode of the diode 125, i.e., by the node 110.

Other consumers may also be wired up in a corresponding manner.

In the triggering of the consumer in this circuit arrangement having a characteristic current profile, one can distinguish among various phases. In a first phase, which, as a rule, only occurs during the first switch-on operation, given a discharged capacitor 145, the first switching means 115 and the second switching means 135 are closed and enable current to flow through the consumer. In this phase, the current flows over the path including the third diode 140, the second switching means 135, the consumer 100, and the first switching means 115.

In a second phase, which is also described as a quenching phase, the first switching means 115 and the second switching means 135 are in their opened state. In this phase, a current flows over the path including the first diode 125, the consumer 100, the second diode 130, and the capacitor 145. During this phase, the energy stored in the consumer 100 is transferred to the capacitor 145, as well as to the voltage source. The aim of the quenching phase is to reduce the current flowing through the consumer in the shortest possible time to the value zero.

In a third phase, the first switching means 115 and the second switching means 135 are closed, and the current flows through the path comprised of the capacitor 145, the second switching means 135, the consumer 100, and the first switching means 115. In this phase, the energy stored in the capacitor 145 is fed back to the consumer, and energy from the voltage source is transferred to the consumer. This phase is also described as the starting breakaway phase. Its aim is, through the application of a high current level, to keep the closing operating time of the solenoid valve as short as possible.

In a fourth phase, the current flows over the path comprised of the third diode 140, the second switching means 135, the consumer 100, and the first switching means 115. In this phase, the energy dissipation is made available from the voltage source. The third diode 140 prevents the capacitor 145 from being positively charged.

In a fifth phase, the so-called holding current phase, the second switching means 135 remains in its closed state, and the switching means 115 is operated in a clocked mode, i.e., it is alternately opened and closed. As a rule, this follows in that a specific current value arises at the midpoint in time. During this clocked phase, in which one alternates between current flow and a free-running mode, the capacitor 145 remains in its discharged state. In the holding current phase, the power loss is reduced by lowering the desired current level and through the clocked mode.

Figure 2:
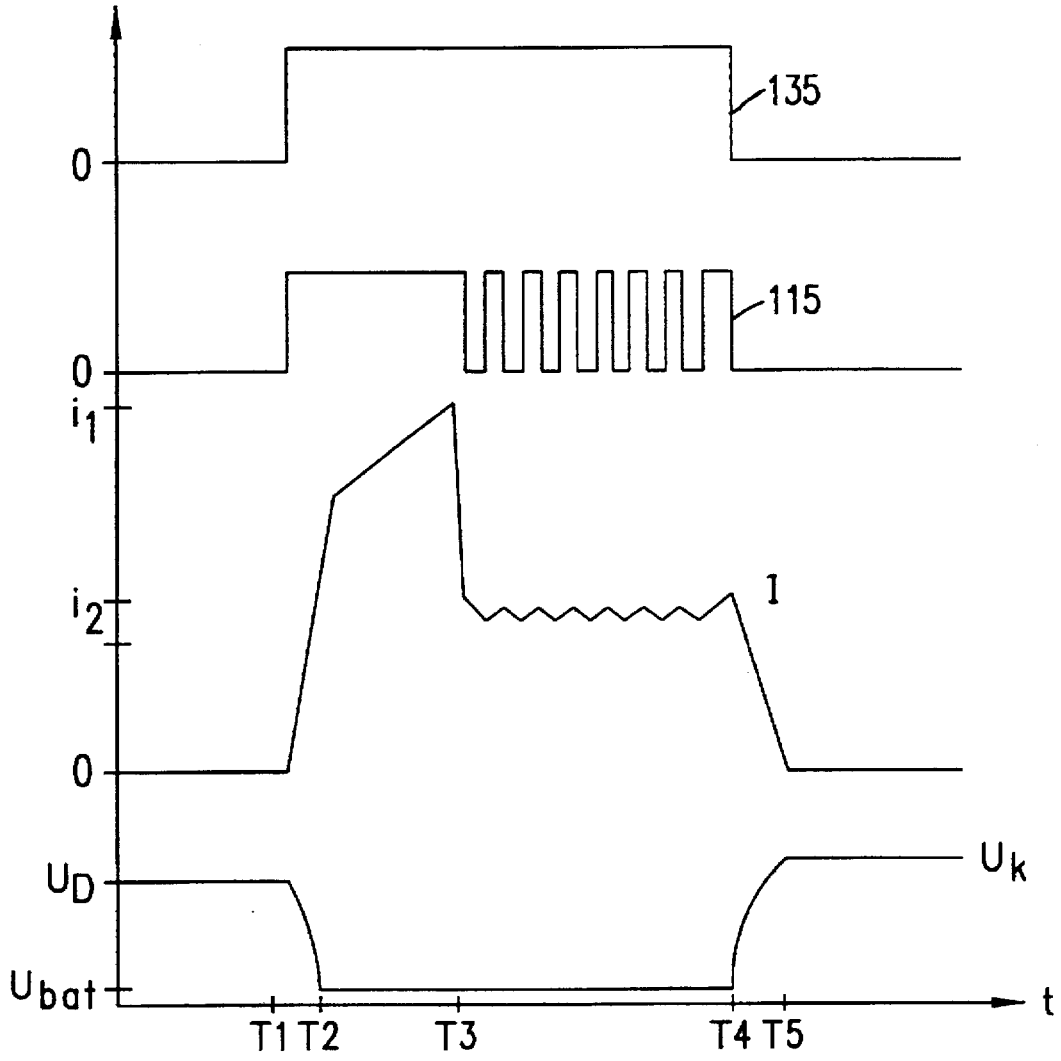
FIG. 2 shows various signals plotted over time.

The method of functioning of this arrangement is described in the following on the basis of FIG. 2. In FIG. 2, various signals are plotted over time. In the first line, a triggering signal for the second switching means 135 is plotted, which defines the triggering of the solenoid valve and, thus, the beginning and the end of the fuel metering. Plotted in the second line is the current flowing through the solenoid valve and, in the third line, the voltage applied to the cathode of the diode 140 connected to ground. Given a closed first switch 115 and second switch 135, this voltage corresponds to the voltage applied over the solenoid valve.

The various phases are also depicted in FIG. 2. At the instant T1, a driver control unit (not shown) emits the control signal depicted in the first line of FIG. 2. The presence of this signal causes the switching means 135 to close. The presence of the signal plotted in the second line causes the first switching means 115 to release the current flow.

If the capacitor 145 has already been charged by an earlier quenching phase, then the third phase begins at the instant T1. This means that the current I flowing through the solenoid valve rises sinusoidally, as plotted in the third line. At the same time, the voltage $U_K$ at the cathode of the third diode 140 connected to ground, as depicted in the fourth line, drops cosinusoidally. This third phase ends at the instant T2.

At the instant T2, the voltage $U_k$ being applied to the cathode of the third diode 140 drops to a value of $U_{bar}$. This means the capacitor 145 is not discharged further, since the voltage $U_c$ being applied to the capacitor assumes the value zero. Furthermore, the third diode 140 prevents a positive charging of the capacitor 145.

Starting with the instant T2 up to the instant T3, the device is in the fourth phase, in which the supply voltage makes available the required energy. The voltage being applied to the third diode 140 or to the capacitor 140 remains at the value zero. The current rises linearly during this phase over time until it reaches its prescribed starting current setpoint value $i_1$.

Depending on the type of electromagnetic consumer 100 being used, the current can also be adjusted in this phase to the starting current setpoint value $i_1$, comparably to the adjustment in the fifth phase.

At the instant T3, the device attains the fifth phase, the so-called clocked phase. In this phase, the first switching means 115 are opened and closed to adjust the current flowing through the consumer to a specifiable holding current setpoint value $i_2$.

Here, one preferably uses a two-step action controller which compares the current flowing through the consumer with a specifiable value. If the current exceeds an upper value, then merely the switching means 115 opens. If the current falls below a lower value, then the switching means 115 opens. As a result, in this fifth phase, the current fluctuates back and forth between the upper and lower value. In this fifth phase, the second switching means 135 remains closed; therefore, there is no transfer of energy between the capacitor 140 and the consumer 100.

Starting with the instant T4, the second phase follows the clocked phase. The trigger signals plotted in the first and second line of FIG. 2 end at the instant T4. This means that both switching means are opened. As a result, the current decreases sinusoidally. At the same time, the voltage $U_k$ at the capacitor 145 or at the cathode of the third diode 140 rises to a value $U_D$ above the supply voltage $U_{bar}$. This means the capacitor is charged again.

In accordance with the present invention, the capacitor 145 and the consumer 100 form a resonant circuit, where the energy is transferred in the second phase from the consumer to the voltage source and to the capacitor 145 and, in the third phase, from the voltage source and the capacitor 145 to the consumer. There is no transfer of energy between the consumer and the capacitor during the clocked operation in the fifth phase.

From this, one attains the advantage that at the beginning and end of current flow through the consumer, there is a rapid change in the current flowing through the consumer in phases two and three, which leads to very short switching times for the consumer. Because in addition to the capacitor 145, the voltage source also makes up a part of the resonant circuit, the quenching phase and the starting phase are shortened and, thus, in addition, also the switching times. Therefore, given a same switching time, a smaller type of construction is attained.

Besides the shortened switch-on/switch-off times, no energy losses occur because of the quenching operation. The energy fed back to the capacitor during the quenching operation is recovered during the switch-on operation.

These advantages are essentially attained through the combination in accordance with the present invention of a half-bridge and of a suitably connected energy-storing element, as well as of the diode 140. This energy-storing element 145 is connected in series between the supply voltage and the half-bridge.

Figure 3A:
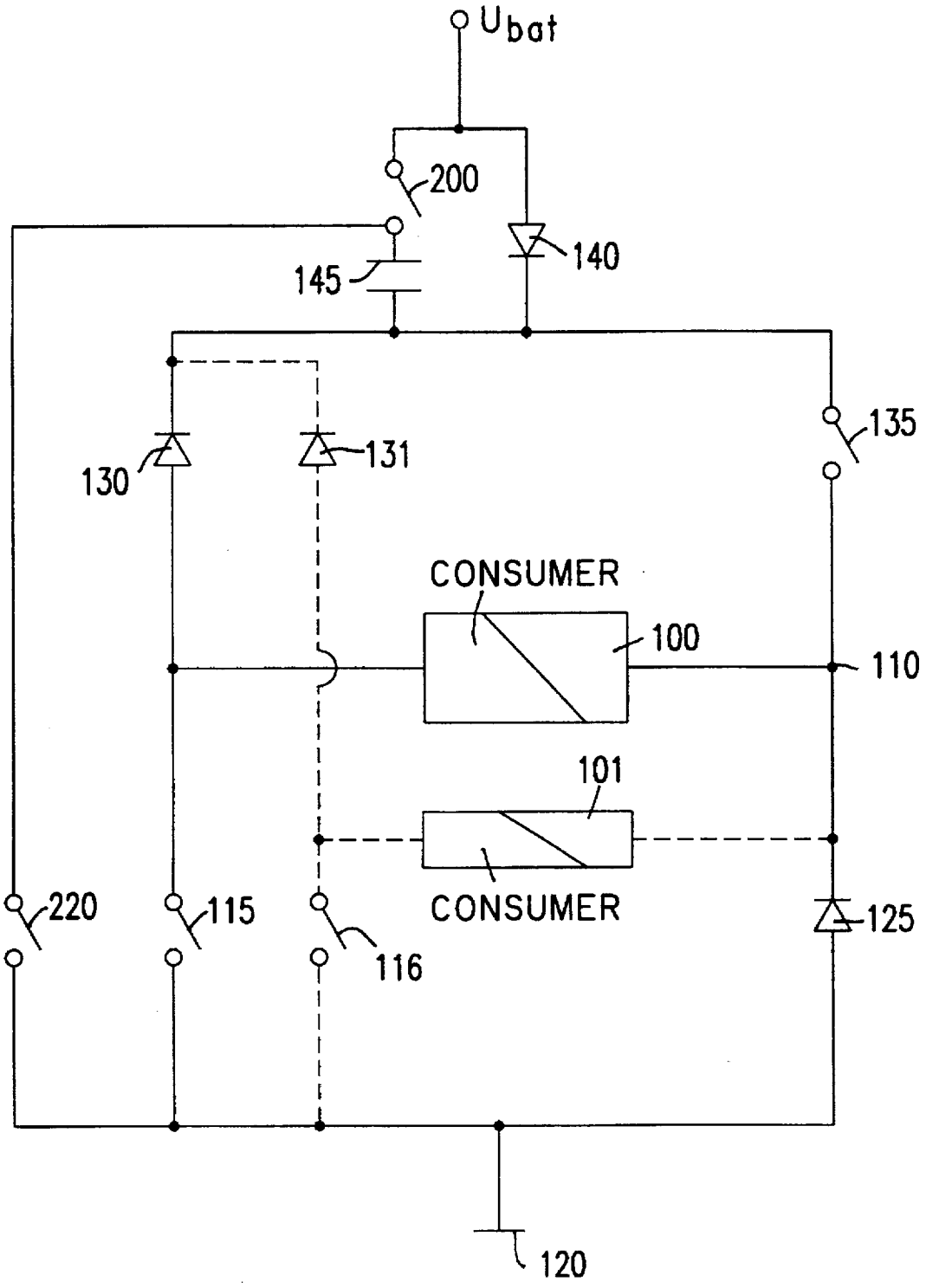
FIG. 3*a* shows a second circuit arrangement of the device according to the present invention.

As a rule, the self-discharging of the capacitor 145 is quite minimal. It can merely happen during start-up operation that the capacitor is partially discharged. This leads to a slower build-up of this first current when current flows through the consumer. To eliminate this disadvantage, another refinement of the present invention is proposed, as depicted in FIG. 3*a*.

Besides the components already described in FIG. 1, which have the same designation as in FIG. 1, another switching means 200 is arranged between the supply voltage and the capacitor 145. In addition to the node between this switching means, there is an additional switching means 220 connected to ground. To charge the capacitor, the switching means 135 and 115 are opened, the additional switching means 220 are closed, and the other switching means 200 are likewise opened. By this means, the capacitor is charged to supply voltage, so that additional energy is available to speed up the first build-up of current after a long standstill.

Figure 3B:
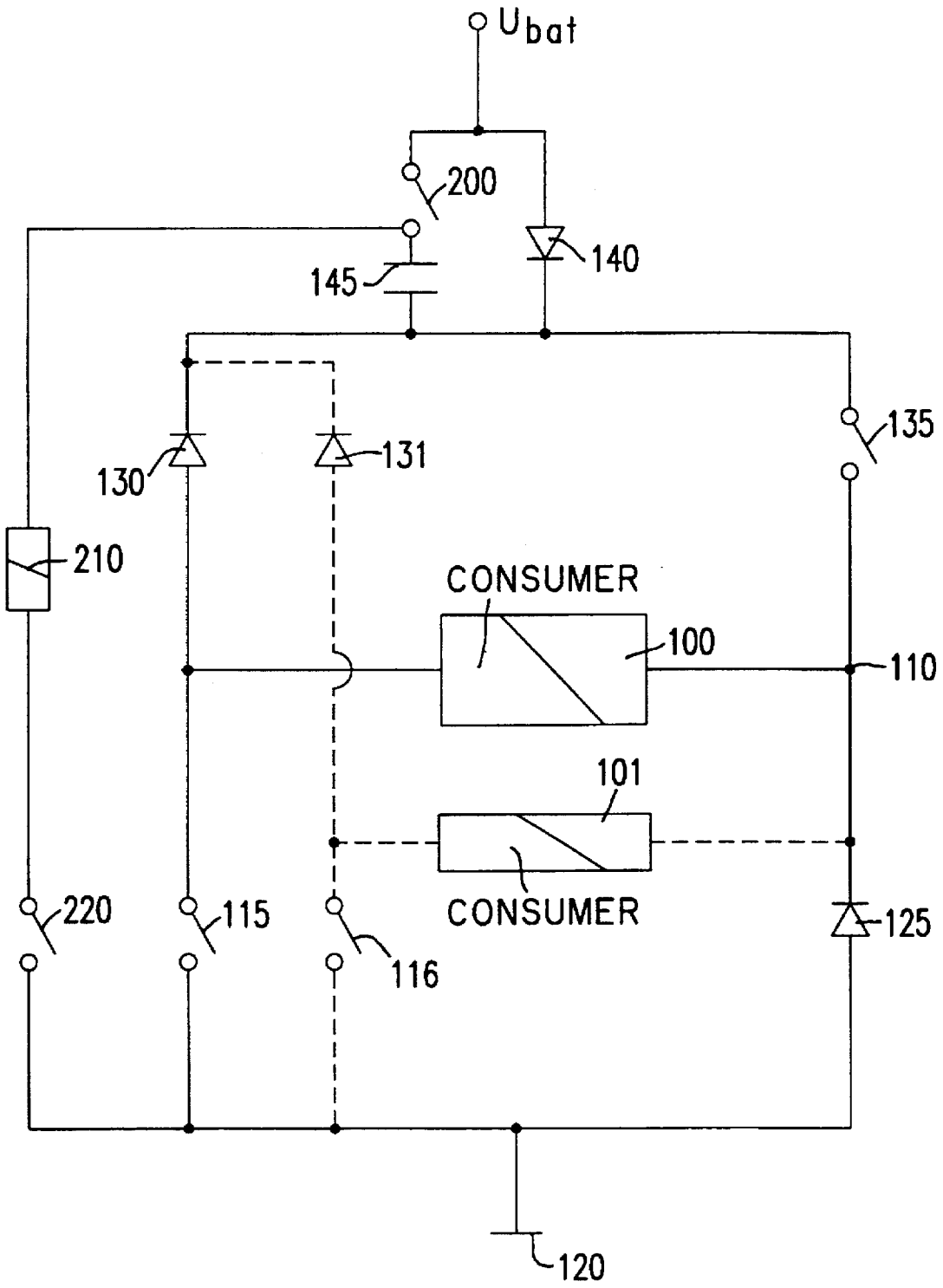
FIG. 3*b* shows a third circuit arrangement of the device according to the present invention.

Another specific embodiment is shown in FIG. 3*b*. Besides the elements already depicted in FIG. 3*a*, an inductor 210 is arranged between the additional switching means 220 and the other switching means 200. The advantage of this circuit arrangement is that the resonant circuit comprised of the inductor 210 and the capacitor 145 charges the capacitor to a voltage which corresponds to double the supply voltage.

Figure 4:
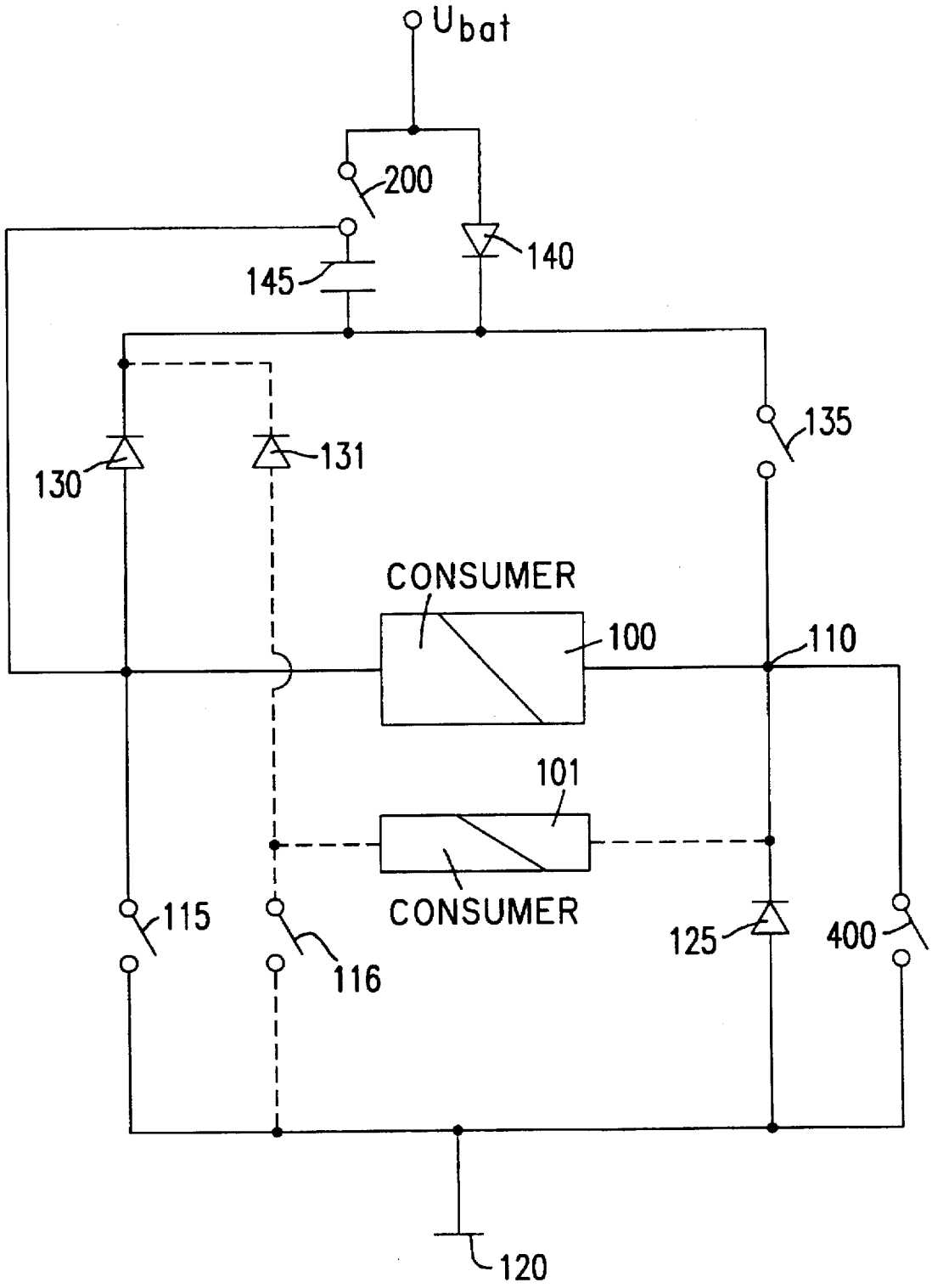
FIG. 4 shows a fourth circuit arrangement of the device according to the present invention.

FIG. 4 illustrates another refinement of the present invention. Besides the components already described in FIG. 1, which have the same designation as those in FIG. 1, another switching means 200 is arranged between the supply voltage and the capacitor 145. The node between this switching means 200 and the capacitor 145 is in contact with the node between the diode 130, consumer 100, and switching means 115.

Furthermore, the node 110 is connected via a switching means 400 to ground.

To charge the capacitor 145, the switching means 135 and 115 are opened, and the switching means 200 and 400 are closed. As a result, the capacitor is charged to a voltage which corresponds to double the supply voltage. In this specific embodiment, the consumer takes on the tasks of the inductor 210.

In this specific embodiment, it is advantageous that there is a corresponding charging of the capacitor, as is possible in the device according to FIG. 3*b*, there being no additional inductors required, however.

The switching means are preferably realized as transistors, especially as field-effect transistors. The switching means receive trigger signals from a control unit (not shown).

What is claimed is:

1. A device for triggering an electromagnetic consumer, comprising:

a half-bridge circuit including a first switching element and a second switching element, wherein the electromagnetic consumer is coupled to ground by the first switching element and to a voltage source by the second switching element; and an energy-storing element coupled between the second switching element of the half-bridge circuit and the voltage source.

2. The device according to claim 1, wherein the electromagnetic consumer includes a solenoid valve for controlling a fuel quantity injected into an engine.

3. The device according to claim 1, wherein the energy-storing element includes a capacitor.

4. The device according to claim 1, further comprising a diode coupled in parallel with the energy-storing element.

5. The device according to claim 1, further comprising a third switching element coupled between the energy-storing element and the voltage source.

6. A method for triggering an electromagnetic consumer comprising the steps of:

arranging an energy-storing element between a voltage source and a half-bridge circuit, the half-bridge circuit including first and second switching elements coupling the electromagnetic consumer to ground and the voltage source, respectively; and triggering at least the second switching element of the half-bridge circuit such that energy is exchanged between the electromagnetic consumer and at least one of the energy-storing element and the voltage source.

7. The method according to claim 6, wherein the electromagnetic consumer includes a solenoid valve for controlling a fuel quantity injected into an engine.

8. The method according to claim 6, further comprising the step of transferring energy from the electromagnetic consumer into at least one of the energy-storing element and the voltage source, in a second phase.

9. The method according to claim 8, wherein the triggering step includes the step of triggering, in the second phase, the first and second switching elements such that current starts flowing in a path including a first diode, the electromagnetic consumer, a second diode, and at least one of the energy-storing element and the voltage source.

10. The method according to claim 8, further comprising the step of transferring energy from at least one of the energy-storing element and the voltage source to the electromagnetic consumer, in a third phase.

11. The method according to claim 10, wherein the triggering step includes the step of triggering, in the third phase, the first and second switching elements such that current starts flowing in a path including the energy-storing element, the first and second switching elements, and the electromagnetic consumer.

12. The method according to claim 6, wherein the first and second switching elements are triggered such that the energy-storing element receives energy from the voltage source.

* * * * *